United States Patent [19]

Wildman et al.

[11] 4,380,135

[45] Apr. 19, 1983

[54] FOUR WHEEL DRIVE TOY

[75] Inventors: John R. Wildman, North Riverside; Howard J. Morrison, Deerfield, both of Ill.

[73] Assignee: Marvin Glass & Associates, Chicago, Ill.

[21] Appl. No.: 291,420

[22] Filed: Aug. 10, 1981

[51] Int. Cl.[3] ..... A63H 17/04

[52] U.S. Cl. ..... 46/219; 46/251; 180/9

[58] Field of Search ..... 46/219, 206, 251, 202, 46/201, 211, 103, 106, 97; 180/8 R, 8 F, 8 B, 7 R, 9, 9.52

[56] References Cited

U.S. PATENT DOCUMENTS

| | | | |
|---|---|---|---|
| 1,106,182 | 8/1914 | Beard | 180/9 X |
| 1,155,872 | 10/1915 | Beard | 46/219 X |
| 2,786,540 | 3/1957 | Sfredda | 46/206 X |
| 3,609,804 | 10/1971 | Morrison | 180/9 |
| 3,900,990 | 8/1975 | Campanell | 46/219 X |

*Primary Examiner*—Mickey Yu

*Attorney, Agent, or Firm*—McDermott, Will & Emery

[57] ABSTRACT

A four wheel drive toy includes a drive mechanism and two pairs of elongated movable track portions mounted on a frame, each pair of track portions including a follower gear driven through an independent gear train from the drive mechanism. An interior surface of each track portion includes an oval endless rack gear engaged by the gear follower. The orbit of the gear follower around the rack gear is made visible from the exterior of the vehicle by using flanges attached to either side of the follower gear to retain the follower gear within the interior of the track portion. The track portion pivots about the axis of the follower gear when the follower gear reaches the arcuate region of the oval rack gear.

3 Claims, 4 Drawing Figures

FOUR WHEEL DRIVE TOY

BACKGROUND OF THE INVENTION

1. Field of the Invention

This invention relates generally to four wheel drive toy vehicles and specifically to such vehicles having moving tracks.

2. Background Art

All terrain toy vehicles, while having an obvious appeal, have been difficult to develop for commercial distribution since track vehicles tend to be too complicated and too dangerous for toy applications. This has led to the development of modified track vehicles such as the vehicle disclosed in U.S. Pat. No. 3,609,804 to Morrison and assigned to the assignee of this application, U.S. Pat. No. 4,051,623, and the references cited therein. That patent describes a toy vehicle having a track portion with an internal rack gear upon which a follower gear rides to move the vehicle forward. When the gear follower reaches the end of a flat portion of the track it causes the track to rotate to present a new flat portion for continued forward movement. The disclosure suggests that any number of track members can be used such as two at the front and two at the rear of the vehicle. However, the respective driving means shown for the front and rear of the vehicles are not independently powered but rather are powered by a common drive. In addition, the outward face of the elongated track is closed to retain the gear follower within the track itself.

SUMMARY OF THE INVENTION

A four wheel drive toy vehicle includes a vehicle frame having a front and rear end. Two pairs of elongated movable track means, a first pair near the front end on opposite sides of the frame and the second pair near the rear end on opposite sides of the frame, are each mounted for independent pivoting movement about a horizontal axis through a full 360°. A driven means independently powers each pair of track means. Each of the track means includes a member having a pair of generally parallel spaced elongated run portions joined at opposite ends by generally arcuate portions. Follower means are carried by the frame and driven by the drive means for movement along each of the track means in proximity to the run portions and the end portions where the track means forms a base on which the follower means moves. The follower means of the track means includes cooperating means providing for pivotal movement on the track means about the follower means as the latter reaches one of said end portions.

DETAILED DESCRIPTION OF THE INVENTION

Figure 1:
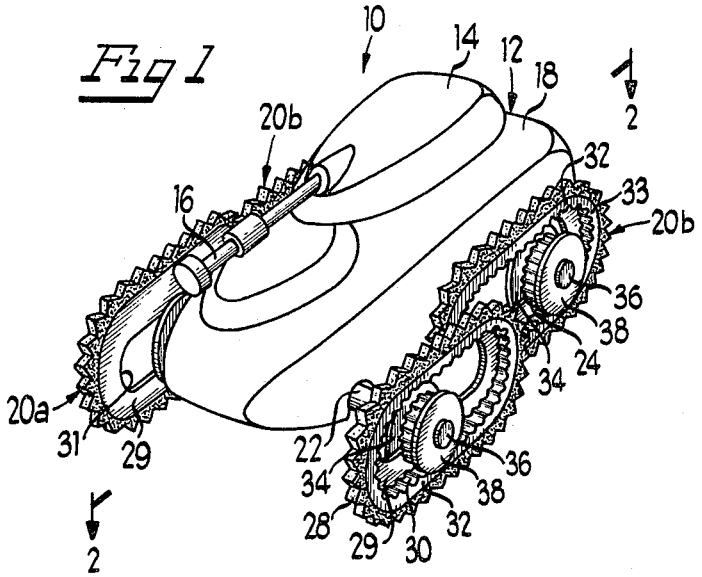
FIG. 1 is a perspective view of one embodiment of the present invention.

Referring to the drawing wherein like reference characters are used for like parts throughout the several views, there is shown in FIG. 1 a four wheel drive toy vehicle 10 including a housing 12 generally in the shape of a tank, conveniently formed by conventional plastic molding techniques to include a rotatable turret 14 with a gun barrel 16 and a body 18. The housing 12 is releasably supported for movement on a set of four elongated track portions 20 connected to the body 18 by axles 22. If desired the housing 12 may be removed and replaced with a variety of differently shaped housings.

Figure 2:
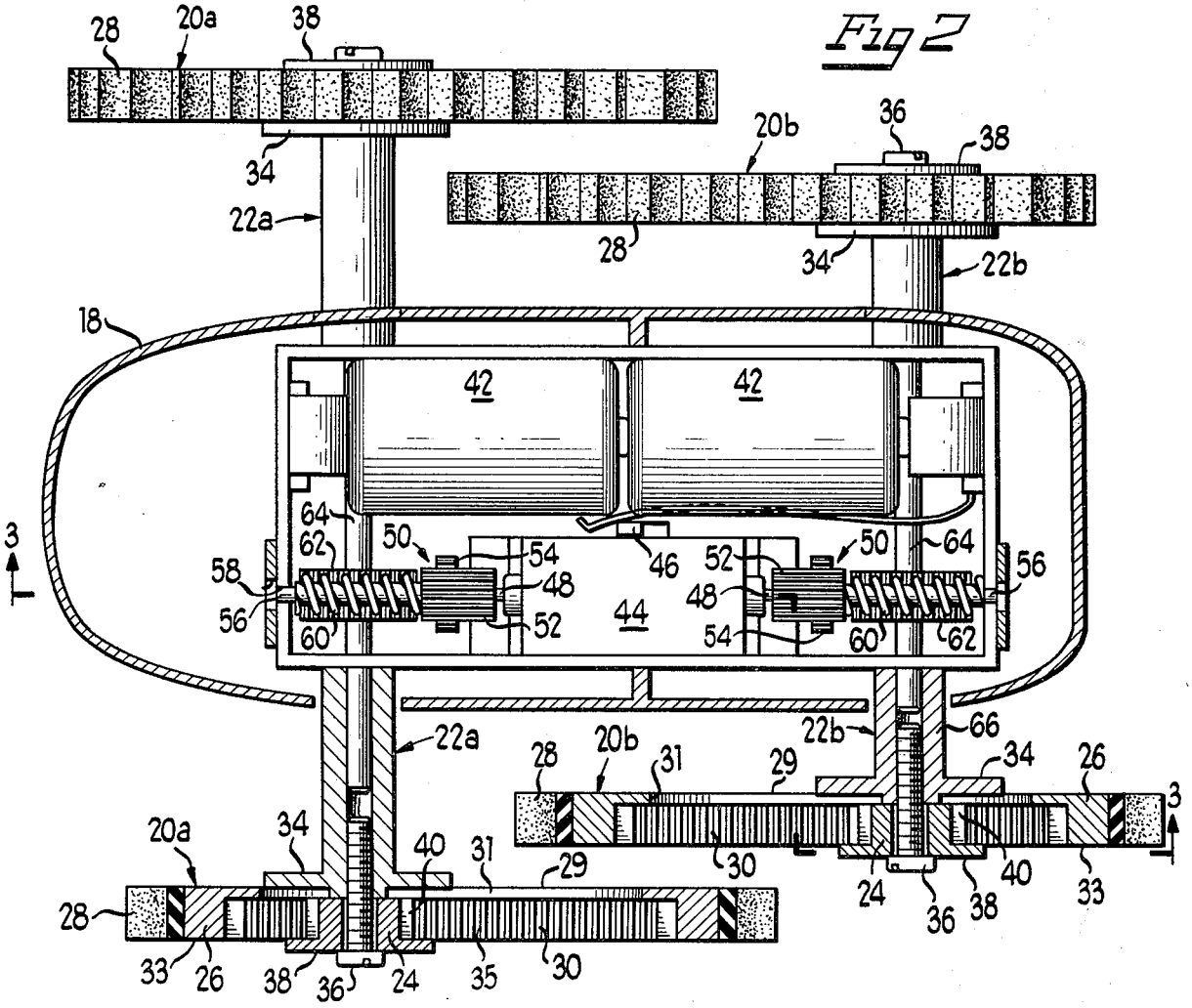
FIG. 2 is an enlarged cross-sectional view taken generally along the line 2—2 in FIG. 1.

As shown in FIG. 2, the front pair of track portions 20*a*, mounted on longer axles 22*a*, are positioned further outwardly of the body 18 than the rear track portions 20*b* which are mounted on shorter axles 22*b* to allow the portions 20*a* to overlap the portions 20*b* without interference between the various portions 20. Each track portion 20 includes a gear follower 24 and a threaded rack gear member 26. The member 26 includes a threaded outer surface 28 conveniently made of sponge rubber or the like, a relatively rigid inwardly facing oval toothed gear 30 in the form of a generally oval loop and a wall portion 29 just inwardly of the gear 30. The wall portion 29 defines an elongate slot 31 that guides the axle 22 which extends through the slot 31 into the recess 35 defined within the gear 30. The teeth of the gear follower 24 are arranged to mate with and to move relative to the teeth of the gear 30, contacting the gear 30 at only one point. Preferrably the diameter of the follower 24 is less than the distance between the straight runs 32 of the oval gear 30 which are separated by arcuate regions 33 so that a gap exists between the top of the follower 24 and the upper run 32.

Each axle 22 includes an inner flange 34 having a diameter greater than the width of the slot 31 in order to retain the threaded rack gear member 26 against inward movement. As shown in FIG. 2, a threaded fastener 36 secures the follower 24 to the axle 22. The follower 24 includes an annular flange 38 on its exposed side whose peripheral diameter is somewhat greater than that of the toothed portion 40 of the follower 24. Thus, the flange 38 overlaps slightly the portion of the treaded rack gear member 26 adjacent the point of contact between the follower 24 and the member 26. In this way the threaded rack gear member 26 is stabilized in a generally vertical configuration between the flanges 34 and 38, and the gear follower 24 is retained for movement along the surface of the gear 30.

Figure 3:
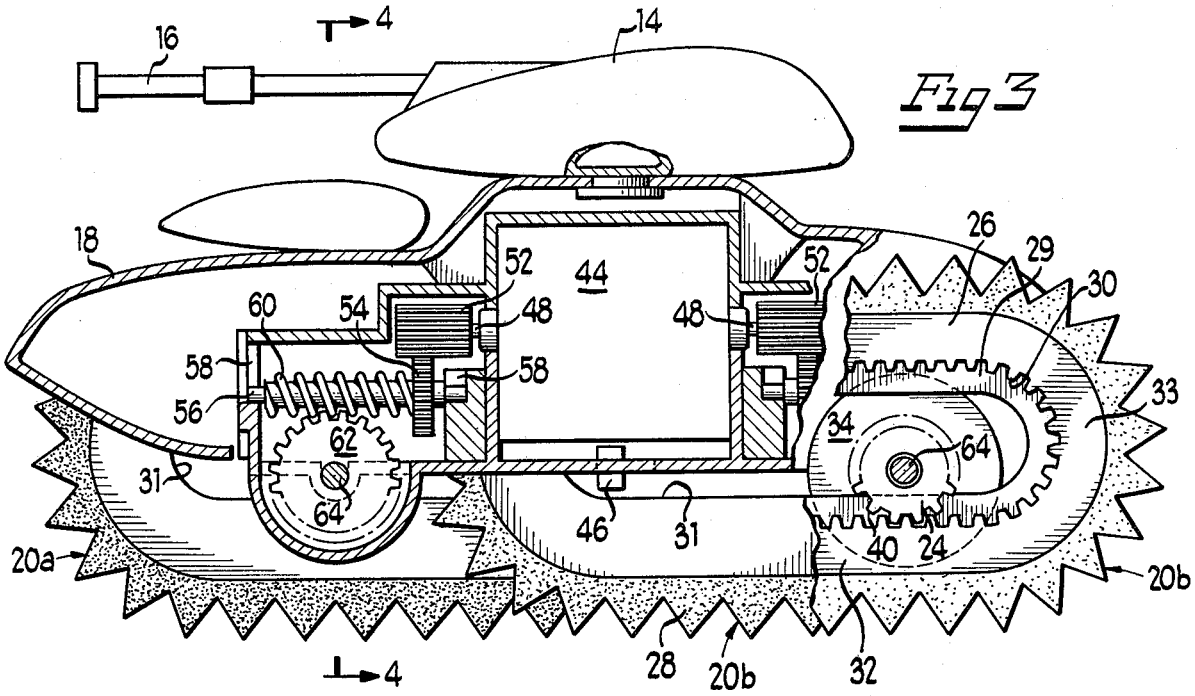
FIG. 3 is a cross-sectional view taken generally along the line 3—3 in FIG. 2.
Figure 4:
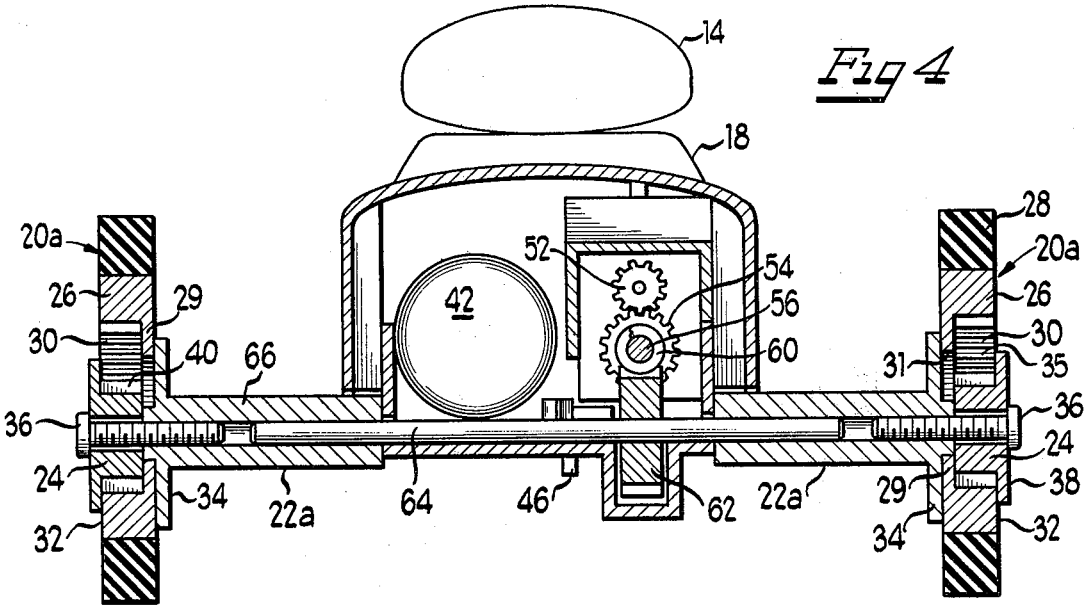
FIG. 4 is a cross-sectional view taken generally along the line 4—4 in FIG. 3.

Within the body 18 batteries 42 supplies potential to a reversible electric motor 44 controlled by an on-off switch 46. The motor 44 drives a pair of axles 48 one extending forwardly and the other extending rearwardly of the generally centrally positioned motor 44. The speed of rotation of each axle 48 is reduced by a separate reducing gear train 50 including a small diameter gear 52 and a meshing large diameter gear 54. As shown in FIGS. 2 and 3 the large diameter gear 54 is mounted on an axle 56 which is retained for free rotation within appropriate slots 58 in the body 18. Each axle 56 also includes a worm gear portion 60 arranged to mesh with a large diameter gear 62 fixed to an axle 22. As shown in FIG. 4, each axle 22 includes a relatively thin rod 64 fixed within a larger portion 66 extending outwardly of the body 18.

The device operates as follows. Upon actuation of the on-off switch 46 the motor 44 rotates the axles 48 resulting in a reduced speed of rotation of the gears 62 attached to each axle 22. The rotation of the axles 22 is transferred to the gear followers 24 which rotate relative to their treaded rack gear members 26. The weight of the vehicle 10 is sufficient to maintain good contact between the follower 24 and the gear 30 so that rotation of the follower 24 results in forward movement of the housing 12 relative to the stationary gear member 26. The movement of the follower 24 along the gear 30 is clearly visible as the flange 38 retains the follower 24 within the member 26 without obstructing the visibility of the inner workings of the vehicle 10. At the same time the inner flange 34 runs along the slot 31 providing access for the axle 22 to the interior of the member 20.

Once the follower 24 has travelled along the entire course of a straight run 32 and approaches the arcuate portion 33 the weight of the vehicle 10 applies a pivotal force to the gear member 26 causing it to rotate around the axis of the axle 22 in the same direction of rotation as the follower 24. This rotation continues until the side of the formerly upwardly facing tread 28 is rotated downwardly atop the supporting surface. Normally the arc of rotation is approximately 180°. However, if the ground is raised in front of the vehicle, the gear member 26 rotates through an arc of less than 180°, and if the ground in front of the vehicle is depressed the member 26 rotates through an arc of greater than 180° until it seats onto the bottom of the depression. In this manner the members 26, pivotally mounted on the housing 12, form a base on which each follower gear 24 moves, thereby allowing the vehicle to move in the desired direction.

In an embodiment in which the diameter of the follower 24 is less than the distance between the straight runs 32, the follower 24 is disengaged from the gear 26 when the track portion 20 overlies a depression in the terrain over which the vehicle 10 is moving. If the depression is below only one of the portions 20, the engaged and disengaged portions 20 actually move out of phase to accommodate the irregularities in the terrain in the direction transverse to the direction of travel of the vehicle 10.

The foregoing detailed description has been given for clearness of understanding only and no unnecessary limitations should be understood therefrom as some modifications will be obvious to those skilled in the art.

What is claimed as new and desired to be secured by Letters Patent is:

1. A four-wheel drive toy vehicle comprising:

a vehicle housing having a front and rear end;

two pairs of identical elongated movable track means for forwarding the vehicle housing over a surface, a first pair of track means near the front end on opposite sides of the housing and a second pair of track means near the rear end on opposite sides of the housing, each track means mounted for independent pivoting movement about a horizontal axis through a full 360°, each of said track means including a member having a pair of generally parallel spaced elongated run portions and end portions, one of said pair of track means being mounted further outwardly of the housing than the other pair, one pair of track means overlapping the other pair to provide a shortened profile for said vehicle, each of said track means defining an elongated central recess;

a symmetrical drive means for driving each of said pairs of track means at the same velocity;

follower means carried by said housing and driven by said drive means for movement along the recess of each of said track means at the same velocity, in proximity to said run portions and said end portions whereby the track means forms a base on which the follower means moves, said follower means including cooperating means providing for pivoting movement of said track means about said follower means as the latter reaches one of said end portions, said follower means further including gears driven by said drive means for rotation about a horizontal axis and adapted to roll about the interior of each recess;

a pair of axles arranged to transmit rotary motion from said drive means to said track means, said axles mounting said follower means, said axles spaced apart by a distance slightly greater than the length of the elongated run portions of said track means, one of said axles being shorter than the other; and means for making the interior of said track means visible from the outside, said means for making the interior of the track means visible including a first flange for each track means, attached to each gear and engaging the exterior side of said track means for relative sliding movement along said track means as said follower means moves relative to said track means, said means for making the interior of said track means visible further including a set of second flanges, each second flange attached to an axle between said first flange and said vehicle housing, said second flange engaging the interior side of said track means for relative sliding movement along said track means as said follower means moves relative to said track means, each of said track means further including a radially inwardly directed flange arranged to abut with said second flange and to be sandwiched between said follower means and said second flange so as to securely and safely retain said track means on said follower means.

2. The vehicle of claim 1 wherein the interior periphery of said recess is a continuous rack gear and said follower gear engages said rack gear to move therealong and move said housing relative to the track means.

3. The vehicle of claim 1, wherein said follower gear has a diameter less than that of said elongated recess to permit said track means to move downwardly relative to said housing should the track means reach a depression in the terrain.

* * * * *